US006027043A

United States Patent [19]

Rosenberg

[11] Patent Number: 6,027,043

[45] Date of Patent: Feb. 22, 2000

[54] SPRAYING DEVICE PARTICULARLY USEFUL AS WATER MINI-SPRINKLER

[76] Inventor: Peretz Rosenberg, Moshav Beit Shearim, 30 046 D.N. Haamakim, Israel

[21] Appl. No.: 09/087,910

[22] Filed: Jun. 1, 1998

[30] Foreign Application Priority Data

Jun. 4, 1997 [IL] Israel ..... 120989

[51] Int. Cl.[7] ..... B05B 1/26

[52] U.S. Cl. ..... 239/382; 239/499; 239/506; 239/524

[58] Field of Search ..... 239/382, 222.17, 239/380, 381, 383, 453, 454, 461, 499, 505, 506, 508, 512, 514–6, 518, 524

[56] References Cited

U.S. PATENT DOCUMENTS

| | | | |
|---|---|---|---|
| 3,267,959 | 8/1966 | Savage | 239/571 |
| 3,731,876 | 5/1973 | Showalter | 239/13 |
| 3,958,760 | 5/1976 | Rosenberg | 239/453 |
| 4,247,050 | 1/1981 | Kumazawa | 239/498 |
| 4,290,557 | 9/1981 | Rosenberg | 239/222.21 |
| 4,356,974 | 11/1982 | Rosenberg et al. | 239/382 |
| 4,523,718 | 6/1985 | Pearson | 239/106 |
| 4,760,957 | 8/1988 | Rosenberg | 239/222.17 |
| 5,472,013 | 12/1995 | Irgens | 137/541 |

*Primary Examiner*—Lesley D. Morris
*Assistant Examiner*—Lisa Ann Douglas
*Attorney, Agent, or Firm*—Benjamin J. Barish

[57] ABSTRACT

A spraying device includes a nozzle head formed with an axial bore connectible to a source of pressurized liquid, an outlet orifice through which the liquid exits in the form of a jet, and a connecting passageway connecting the inlet end to the outlet orifice. A rod passes through the axial bore; and a liquid distribution member is secured to the rod at the outlet orifice to distribute the liquid laterally of the nozzle head. The rod carries an abutment at the bore inlet end and is displaceable axially and laterally within the bore. The connecting passageway of the axial bore, and the adjacent portion of the rod, include complementary conical surfaces defining between them a metering passageway for the liquid flowing to the outlet orifice such that, during operation of the spraying device, the axial position of the rod within the bore, as determined by the abutment, determines the output rate of the spraying device.

19 Claims, 3 Drawing Sheets

FIG. 1
(PRIOR ART)
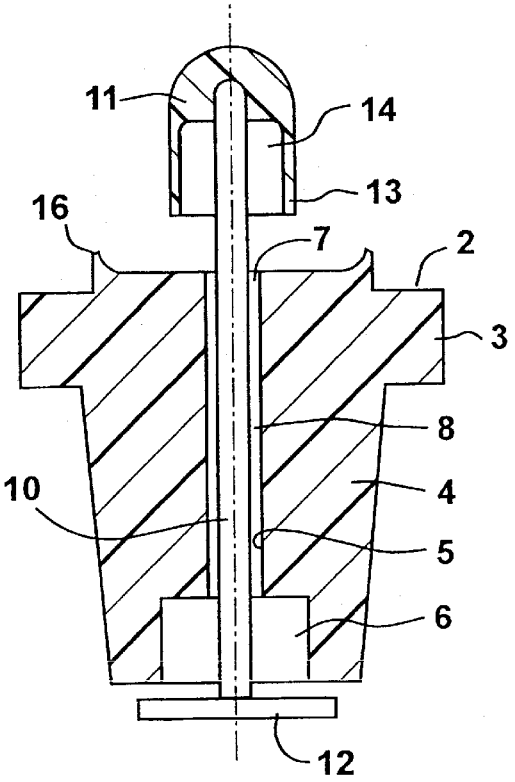
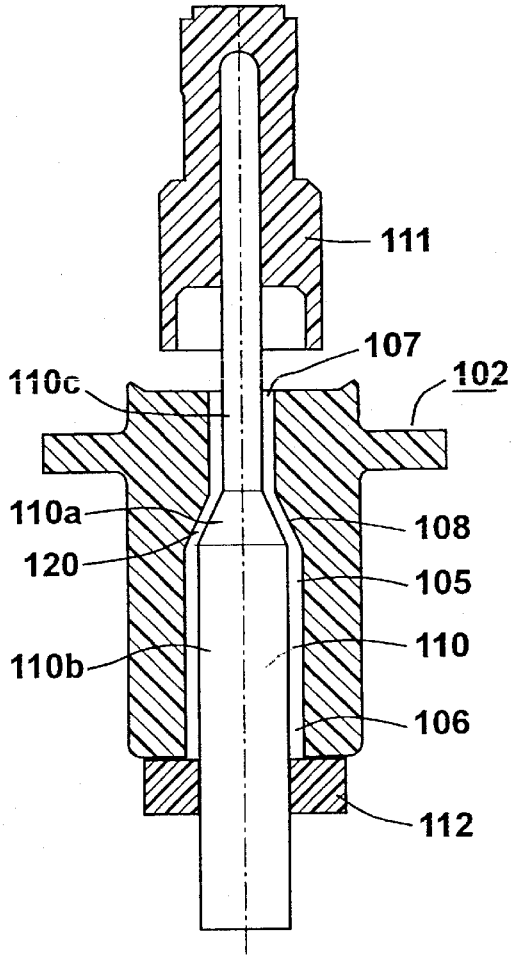
FIG. 2
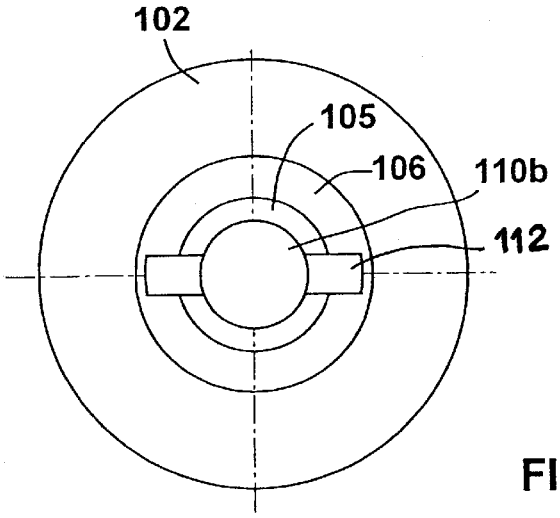
FIG. 3

FIG. 4
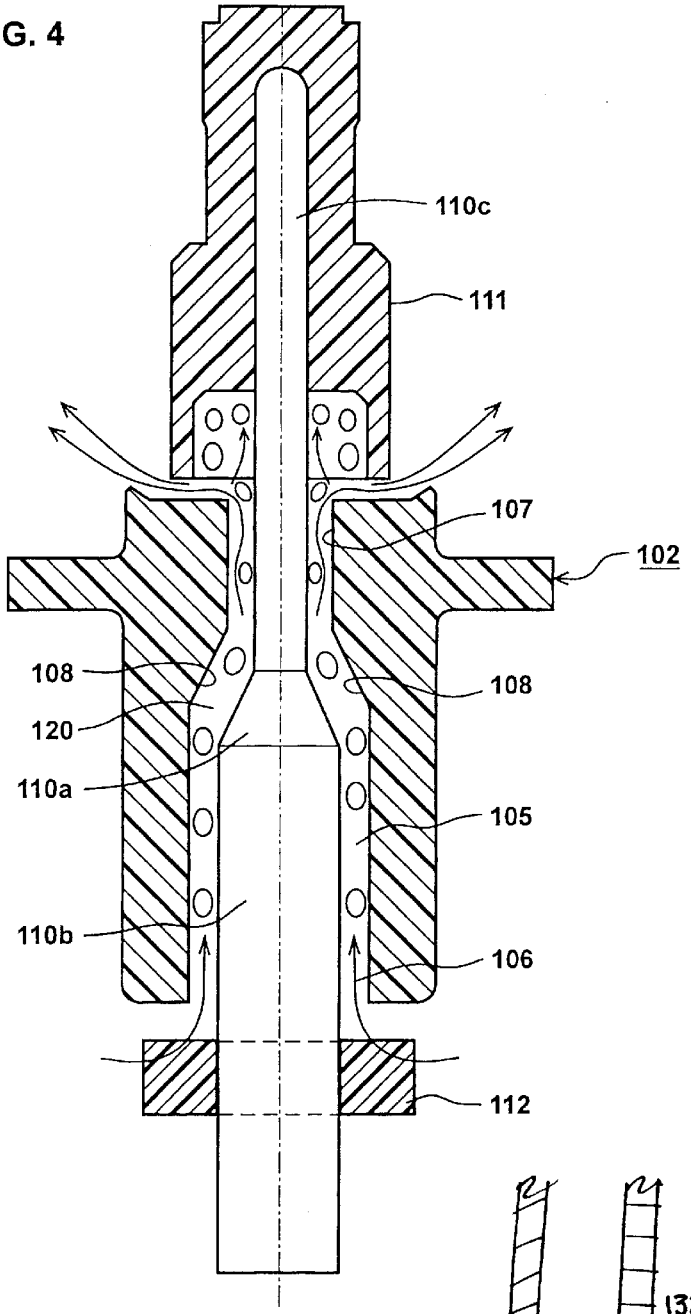
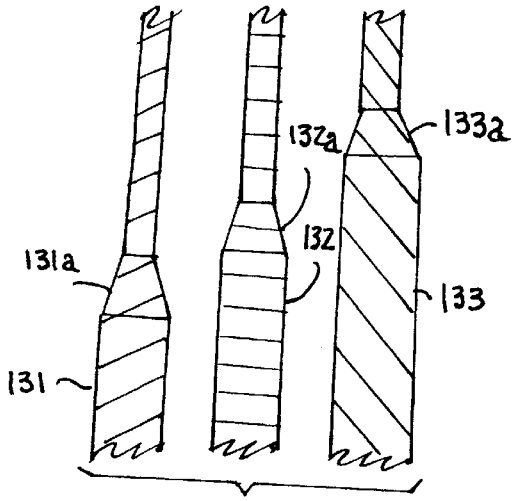
FIG. 7

SPRAYING DEVICE PARTICULARLY USEFUL AS WATER MINI-SPRINKLER

FIELD AND BACKGROUND OF THE INVENTION

The present invention relates to spraying devices, and particularly to the type of spraying devices described in my Israel Patent 61186 (U.S. Pat. No. 4,356,974), as well as in my Israel Patents 45916 (U.S. Pat. No. 3,958,760), and 78235 (U.S. Pat. No. 4,760,957).

Spraying devices of the foregoing type are used as mini-sprinklers in water irrigation systems. Such mini-sprinklers generally comprise a nozzle head formed with an axial bore therethrough having an inlet end connectible to a source of pressurized liquid, an outlet end defining an outlet orifice through which the liquid exits in the form of a jet, and a connecting passageway connecting the inlet end to the outlet orifice; a rod passing through the axial bore; and a liquid distribution member secured to the rod at the outlet orifice end thereof to distribute the liquid laterally of the nozzle head. The rod is of smaller transverse dimension and of longer length than the axial bore and carries an abutment at the bore inlet end thereof such that the rod is displaceable both axially and laterally within the axial bore.

The output rate of such mini-sprinklers is determined by the cross-section of the flow passage defined by the space between the rod and the surface of the axial bore. Different applications of such mini-sprinklers require different flow rates, and therefore such mini-sprinklers are supplied in a range of different flow rates according to the dimensions of the rod and the axial bore.

OBJECTS AND BRIEF SUMMARY OF THE INVENTION

An object of the present invention is to provide a spraying device particularly of the foregoing type which can be constructed so as to provide a wide range of flow rates and to permit changing the flow rate in a convenient and efficient manner. Another object of the invention is to provide a spraying device of the foregoing type which also permits the device to be self-regulating with variations in the inlet pressure.

According to the present invention, therefore, there is provided a spraying device of the foregoing type, characterized in that the connecting passageway of the axial bore, and the adjacent portion of the rod, include complementary conical surfaces defining between them a metering passageway for the liquid flowing to the outlet orifice such that, during operation of the spraying device, the axial position of the rod within the bore, as determined by the abutment, determines the output rate of the spraying device.

According to further features in one described preferred embodiment, the device includes at least one spacing ring receivable on the rod between the abutment and the inlet end of the nozzle head, to increase the transverse dimensions of the metering passageway, and thereby the output rate of these spraying device. Preferably there are a plurality of spacing rings of different thicknesses, receivable on the rod between the abutment and the inlet end of the nozzle head, to enable fixing the desired output rate by applying the appropriate spacing rings. Such spacing rings may be color-coded to permit fixing the output rate of the device according to the color-coded spacing ring or rings included.

According to a further optional feature, the spacing ring or rings may be of resilient material which compresses in accordance with the axial force applied by the liquid jet against the liquid distribution member, to thereby regulate the output rate of the spraying device with pressure changes in the source of pressurized liquid.

Another described preferred embodiment supplies the device with a plurality of rods having abutments at different positions along the length of the rod to permit the user to select the desired output rate of the spraying device by selecting the appropriate rod. Such rods and abutments are preferably color-coded according to the desired output rate.

A still further described embodiment makes the abutment adjustable on the rod to thereby enable presetting the output rate.

Further features and advantages of the invention will be apparent from the description below.

BRIEF DESCRIPTION OF THE DRAWINGS

The invention is herein described, by way of example only, with reference to the accompanying drawings, wherein:

FIG. 1 is a sectional view illustrating a spraying device of the prior art, e.g., as described in my above-identified Israel Patent 61186 (U.S. Pat. No. 4,356,974);

FIG. 2 is a corresponding sectional view illustrating a spraying device constructed in accordance with the present invention;

FIG. 3 is a bottom plan view of the device of FIG. 2;

FIG. 4 illustrates the manner of flushing the device of FIGS. 2 and 3;

FIG. 7 illustrates a plurality of the spraying device rods which may be supplied to the user to enable selection of the desired output rate of the spraying device by selecting the appropriate rod.

DESCRIPTION OF PREFERRED EMBODIMENTS

Figure 5:
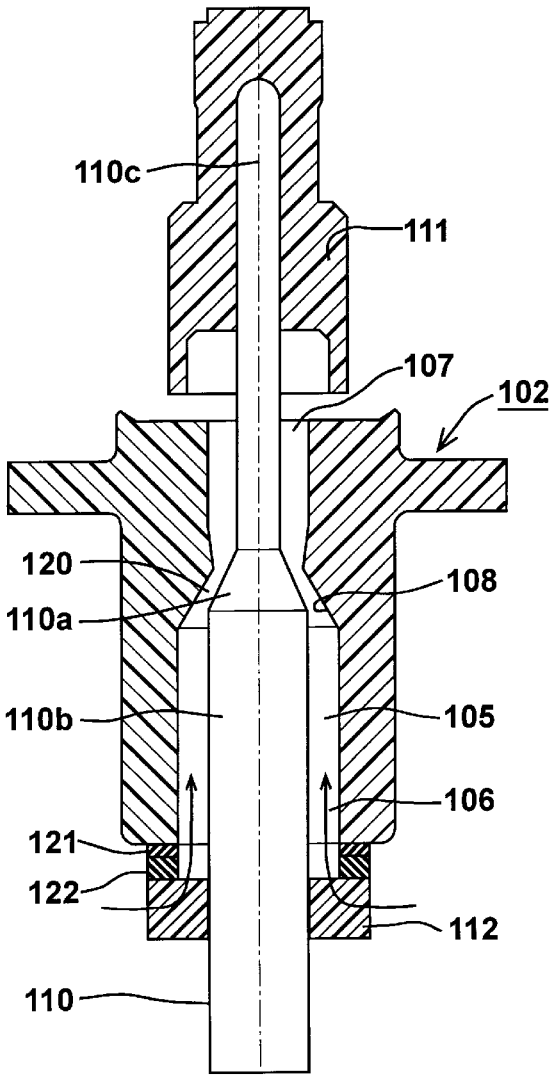
FIG. 5 is a view corresponding to that of FIG. 2, but illustrating one manner of presetting the output rate of the device.

The prior art spray device illustrated in FIG. 1 (as described in my Israel Patent 61186 (U.S. Pat. No. 4,356,974) includes a nozzle head 2 formed with an upper section 3 and a lower section 4 for attachment, e.g., by friction fit, to a water supply pipe or other source (not shown) supplying pressurized water to the spraying device. Nozzle head 2 is formed with an axial bore 5 having an inlet end 6 connectible to the source of pressurized water, an outlet end defining an outlet orifice 7 through which the water exits in the form of a jet, and a connecting passageway 8. A rod 10 passes through bore 5. One end of rod 10 carries a water distribution member 11, of cup-shaped configuration, to be impinged by the jet from orifice 7 and to distribute the water laterally of the spraying device. The opposite end of rod 10 carries an abutment 12 engageable with the lower face of the nozzle head 2 for limiting the outward movement of rod 10 and the water distribution member 11.

In such a spraying device, the rod 10 is of smaller transverse dimension (i.e., of smaller diameter) and of larger length than the axial bore 5, such that the rod is displaceable both axially and laterally within the bore. The cup-shaped member 11 has a thin wall 13 defining an open end 14 of slightly larger diameter than that of the outlet orifice 7.

Nozzle head 2 facing the cup-shaped member 11 is substantially flat, but includes an upwardly inclined surface 16 at its outer margin to produce an inclined spray laterally of the device.

Further features regarding the construction and operation of such a spraying device, or mini-sprinkler, are publically available, e.g., in the above-cited patents.

As briefly brought out above, such a mini-sprinkler is generally provided in a wide range of output rates, determined by the cross-section of the space between rod 10 and the outlet orifice 7. Providing such devices in a wide range of output rates increases the manufacturing costs, as well as the inventory costs.

FIGS. 2 and 3 illustrate a spraying device of the general construction as in FIG. 1, but modified in accordance with the present invention.

Thus, the sprinkler illustrated in FIGS. 2 and 3 includes a nozzle head 102 formed with an axial bore 105 having an inlet end 106 connectible to a source of pressurized water, and an outlet end 107 defining an outlet orifice through which the water exits in the form of a jet. As in FIG. 1, a rod 110 is received within the axial bore 105 and carries the water distribution member 111 at one end, and an abutment 112 at the opposite end.

In the construction of the spraying device illustrated in FIGS. 2 and 3, however, the outlet orifice 107 of the axial bore 105 is connected to the inlet end 106 of the bore by means of a passageway having a conical section, as shown at 108, decreasing in diameter towards the outlet orifice. In addition, the adjacent portion of the rod 110 is formed with a complementary conical surface, as shown at 110*a,* which defines, with conical surface 108 of the axial bore 105, a metering passageway 120 for the water flowing from the inlet end of the bore to the outlet orifice 107.

For passageway 120 to serve as a metering passageway controlling the output rate of the spraying device, that passageway must be of the smallest cross-sectional area of the water flow from the inlet end 106 of bore 105 to the outlet orifice 107. For this reason, the diameter of the inlet end 106 of bore 105, and also the diameter of rod section 110*b* occupying the inlet end of the bore, are of larger diameter than outlet orifice 107 and the section 110*c* of rod 110 occupying it. In addition, the clearances between these respective portions of the axial bore 105 and the rod 110 are larger than the cross-sectional area of clearance 120 between the conical surfaces 108 of the axial bore and rod section 110*a* of the rod.

It will be seen that during the operation of the spraying device illustrated in FIGS. 2 and 3, the cross-sectional area of clearance 120 is determined by the position of abutment 112 on rod 110, and therefore the position of this abutment determines the output rate of the spraying device. Thus, if abutment 112 is moved away from the water distribution member 111, this will decrease clearance 120, and thereby decrease the output rate of the device; whereas if abutment 112 is moved towards the water distribution member 111, this will increase the cross-sectional area of clearance 120 and thereby increase the output rate of the spraying device.

Rod 110 and abutment 112 can be constructed in a plurality of different sizes to enable the user to select the desired output rate by selecting the appropriate rod and abutment. For this purpose, the rods could be color-coded indicating the various output rates. To change the output rate, it is only necessary to remove the water distribution member 11 from the end of the rod, replace the rod with the appropriate one for the desired output rate, and then reattach the water distribution member 11 by a press fit. This is shown in FIG. 7, illustrating three such rods 131, 132, 133, having conical surfaces 131*a,* 132*a,* 133*a* at different axial positions along the length of the rod to enable the desired output rate to be selected, and color-coded to facilitate such selection.

Another important advantage in the sprinkler illustrated in FIGS. 2 and 3 is that it is self-flushing of clogged particles whenever the water supply is turned off. This is shown in FIG. 4. Thus, any clogging particles would tend to wedge between surfaces 110*a* and 108 defining the clearance 120 of smaller cross-sectional area. As soon as the water is turned off, the weight of rod 110, together with its water distribution member 111, would cause the rod to drop until member 110 engages the upper surface of the nozzle head 102, thereby increasing the cross-sectional area of clearance 120 and freeing any clogging particles, which will tend to be flushed out during the next operation of the spraying device.

The spraying device may also be flushed by merely manually pressing down on the water distribution member 111 during the operation of the sprinkler, which will also increase the space of clearance 120 to cause flushing particles to be flushed out.

FIG. 5 illustrates the use of one or more spacing rings receivable on the rod 110 between its abutment 112 and the inlet end of the nozzle 102, to increase the cross-sectional area of clearance 120, and thereby to increase the output rate. Thus, FIG. 5 illustrates the use of two such spacing rings 121, 122, of different thicknesses, so that the desired output rate can be provided. Preferably, the spacing rings 121, 122 are color-coded to enable the user to conveniently select the desired output rate.

Figure 6:
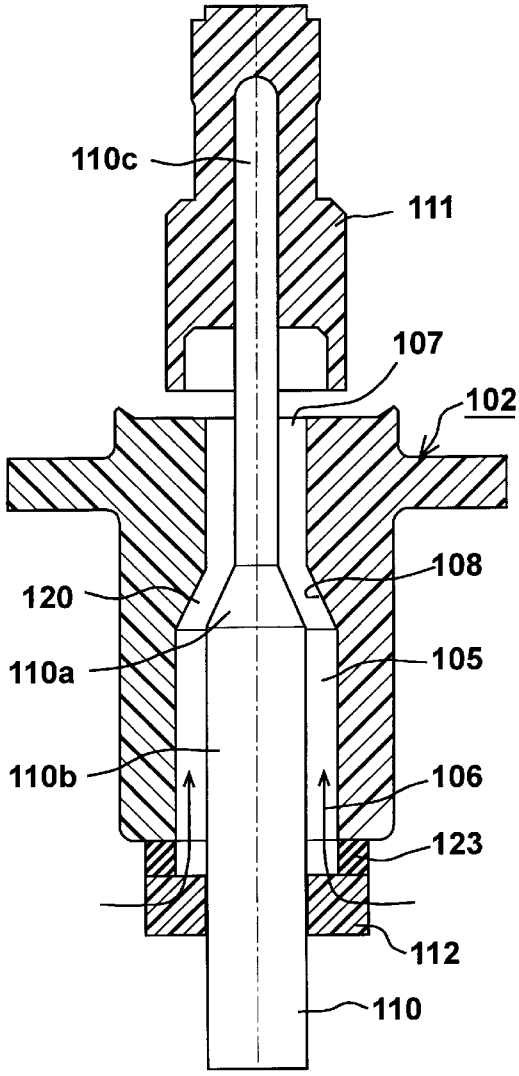
FIG. 6 is a view corresponding to that of FIG. 2, but illustrating one manner of providing the device with regulation.

FIG. 6 illustrates a further variation, wherein a spacing ring, therein designated 123, of resilient material is provided between the abutment 112 and the outlet end of nozzle head 102. Resilient ring 123 may be of soft rubber or other resilient material which compresses according to the axial force applied by the water jet against the water distribution member 111. A larger force applied by the jet, produced by a larger inlet water pressure, will compress ring 123 to reduce the cross-sectional area of clearance 120, and thereby compensate for the larger inlet pressure. Thus, the use of the resilient ring 123 in this construction provides a self-regulating feature to the spraying device.

Another alternative for changing the output rate is to make abutment 112 adjustable on rod 110, e.g., by threading both or by a friction fit which permits adjustment.

While the invention has been described with respect to several preferred embodiments, it will be appreciated that these are set forth merely for purposes of example, and that many other variations, modifications and applications of the invention may be made.

What is claimed is:

1. A spraying device comprising:

a nozzle head formed with an axial bore therethrough having an inlet end connectible to a source of pressurized liquid, an outlet end defining an outlet orifice through which the liquid exits in the form of a jet, and a connecting passageway connecting said inlet end to said outlet orifice;

a rod passing through said axial bore;

and a liquid distribution member secured to said rod at the outlet orifice end thereof to distribute the liquid laterally of the nozzle head;

said rod being of smaller transverse dimension and of longer length than said axial bore and carrying an abutment at the bore inlet end thereof such that the rod is displaceable both axially and laterally within said axial bore;

characterized in that said connecting passageway of the axial bore, and the adjacent portion of the rod, include complementary conical surfaces defining between them a metering passageway for the liquid flowing to the outlet orifice such that, during operation of the spraying device, the axial position of the rod within said bore, as determined by said abutment, determines the output rate of the spraying device.

2. The device according to claim 1, wherein the device further includes at least one spacing ring receivable on the rod between said abutment and the inlet end of the nozzle head, to increase the transverse dimensions of the metering passageway, and thereby the output rate of the spraying device.

3. The device according to claim 2, wherein there are a plurality of said spacing rings of different thicknesses receivable on the rod between said abutment and the inlet end of the nozzle head, to enable fixing the desired output rate by applying the appropriate spacing rings.

4. The device according to claim 3, wherein said plurality of rings are color-coded.

5. The device according to claim 2, wherein said at least one spacing ring is of resilient material which compresses according to the axial force applied by the liquid jet against the liquid distribution member, to thereby regulate the output rate of the spraying device with pressure changes in the source of pressurized liquid.

6. The device according to claim 1, wherein the device is supplied with a plurality of said rods having abutments at different positions along the length of the rod to permit the user to select the desired output rate of the spraying device by selecting the appropriate rod.

7. The device according to claim 6, wherein said rods and abutments are color-coded according to the desired output rate.

8. The device according to claim 1, wherein said abutment is adjustably carried by said rod to thereby enable presetting the output rate of said device.

9. The device according to claim 8, wherein said liquid distribution member is a cup-shaped member having a thin wall defining an open end facing, and of slightly larger diameter than, said outlet orifice.

10. A spraying device comprising:

a nozzle head formed with an axial bore therethrough having an inlet end connectible to a source of pressurized liquid, an outlet end defining an outlet orifice through which the liquid exits in the form of a jet, and a connecting passageway connecting said inlet end to said outlet orifice;

a rod passing through said axial bore;

a cup-shaped liquid distribution member secured to said rod at the outlet orifice end thereof to distribute the liquid laterally of the nozzle head;

said rod being of smaller transverse dimension and of longer length than said axial bore and carrying an abutment at the bore inlet end thereof such that the rod is displaceable both axially and laterally within said axial bore;

said connecting passageway of the axial bore, and the adjacent portion of the rod, including complementary conical surfaces defining between them a metering passageway for the liquid flowing to the outlet orifice such that, during operation of the spraying device, the axial position of the rod within said bore, as determined by said abutment, determines the output rate of the spraying device;

and at least one spacing ring receivable on the rod between said abutment and the inlet end of the nozzle head, to increase the transverse dimensions of the metering passageway, and thereby the output rate of the spraying device.

11. The device according to claim 10, wherein there are a plurality of said spacing rings of different thicknesses receivable on the rod between said abutment and the inlet end of the nozzle head, to enable fixing the desired output rate by applying the appropriate spacing rings.

12. The device according to claim 11, wherein said plurality of rings are color-coded.

13. The device according to claim 10, wherein said at least one spacing ring is of resilient material which compresses according to the axial force applied by the liquid jet against the liquid distribution member, to thereby regulate the output rate of the spraying device with pressure changes in the source of pressurized liquid.

14. The device according to claim 10, wherein the device is supplied with a plurality of said rods having abutments at different positions along the length of the rod to permit the user to select the desired output rate of the spraying device by selecting the appropriate rod.

15. The device according to claim 14, wherein said rods and abutments are color-coded according to the desired output rate.

16. The device according to claim 10, wherein said cup-shaped liquid distribution member has a thin wall defining an open end facing, and of slightly larger diameter than, said outlet orifice.

17. A spraying device comprising:

a nozzle head formed with an axial bore therethrough hating an inlet end connectible to a source of pressurized liquid, an outlet end defining an outlet orifice through which the liquid exits in the form of a jet, and a connecting passageway connecting said inlet end to said outlet orifice;

and a liquid distribution member secured to a selected said rod at the outlet orifice end thereof to distribute the liquid laterally of the nozzle head;

a plurality of rods each of which is selectable for passing through said bore, each of said rods being of smaller transverse dimension and of longer length than said axial bore and carrying an abutment at the bore inlet end thereof such that the rod when passed through said bore, is displaceable both axially and laterally within said axial bore;

said connecting passageway of the axial bore, and the adjacent portion of the rod, including complementary conical surfaces defining between them a metering passageway for the liquid flowing to the outlet orifice such that, during operation of the spraying device, the axial position of the rod within said bore, as determined by said abutment, determines the output rate of the spraying device;

the abutments of said plurality of rods being at different positions along the length of the respective rod to permit the user to select the desired output: rate of the spraying device by selecting the appropriate rod and abutment.

18. The device according to claim 17, wherein said rods and abutments are color-coded according to a desired output rate.

19. The device according to claim 17, wherein said liquid distribution member is a cup-shaped member having a thin wall defining an open end facing, and of slightly larger diameter than, said outlet orifice.

* * * * *